United States Patent [19]

Bauer et al.

[11] Patent Number: 4,819,377

[45] Date of Patent: Apr. 11, 1989

[54] FLUSH WINDOW REGULATOR

[75] Inventors: Barney J. Bauer, Grosse Pointe Woods, Mich.; William E. Buehler, Toledo, Ohio

[73] Assignee: Dura Automotive Hardware Division of Wickes Manufacturing Company, Toledo, Ohio

[21] Appl. No.: 209,923

[22] Filed: Jun. 22, 1988

[51] Int. Cl.[4] ..... E05D 15/10

[52] U.S. Cl. ..... 49/221; 49/349; 49/375

[58] Field of Search ..... 49/211, 221, 225, 348, 49/349, 352, 373, 375

[56] References Cited

U.S. PATENT DOCUMENTS

| | | | |
|---|---|---|---|
| 1,045,279 | 11/1912 | Gradick, Sr. . | |
| 1,085,877 | 2/1914 | Rheims et al. . | |
| 1,390,003 | 9/1921 | Whitehead . | |
| 1,412,142 | 4/1922 | Sonnemann . | |
| 1,501,453 | 7/1924 | Humer . | |
| 1,570,011 | 1/1926 | Serste . | |
| 1,872,976 | 8/1932 | Kraemer . | |
| 2,112,330 | 3/1938 | Carr | 296/44 |
| 2,979,327 | 4/1961 | Swanson et al. | 268/124 |
| 3,261,128 | 7/1966 | Slopa et al. | 49/98 |
| 3,386,206 | 6/1968 | Loveless | 49/221 |
| 3,994,094 | 11/1976 | Marzocco | 49/212 |
| 4,240,226 | 12/1980 | Georgelin | 49/223 |
| 4,543,747 | 10/1985 | Kaltz et al. | 49/249 |
| 4,550,529 | 11/1985 | Drouillard | 49/348 |
| 4,561,211 | 12/1985 | Raley et al. | 49/374 |

*Primary Examiner*—Kenneth J. Dorner
*Assistant Examiner*—Gerald Anderson
*Attorney, Agent, or Firm*—Hugh A. Kirk

[57] ABSTRACT

The disclosure concerns a regulator for moving a window in a vehicle door successively substantially vertically and horizontally and vice versa. In other words, once the window is closed vertically the lower edge may be moved outwardly horizontally to become more flush with the outside surface of the door of the vehicle. The regulator comprises a closed loop of cable wrapped about a reversible driving drum and having a vertical reach which is attached to a pulley connected to the carrier for the window. This pulley is provided with a pair of diametrically opposite cam follower pins or rollers that are guided in a vertical slot parallel to the vertical reach of cable, which slot has a bifurcated or Y-shaped pair of slots at its upper end for rotating the pulley up to about 180° when the pulley reaches the "Y" and the cable means continues to pull. The pulley also has a helical groove axial and integral therewith for positively screwing the carrier attached to the lower edge of the window outwardly horizontally. This carrier has a socket with a radial pin therein fitting into said helical groove so that oscillation of said pulley produces the horizontal reciprocating motion of the carrier and lower edge of the window. When the cable then pulls in the other direction on the pulley, it positively screws the window carrier inwardly horizontally before lowering the window carrier to open the window.

10 Claims, 3 Drawing Sheets

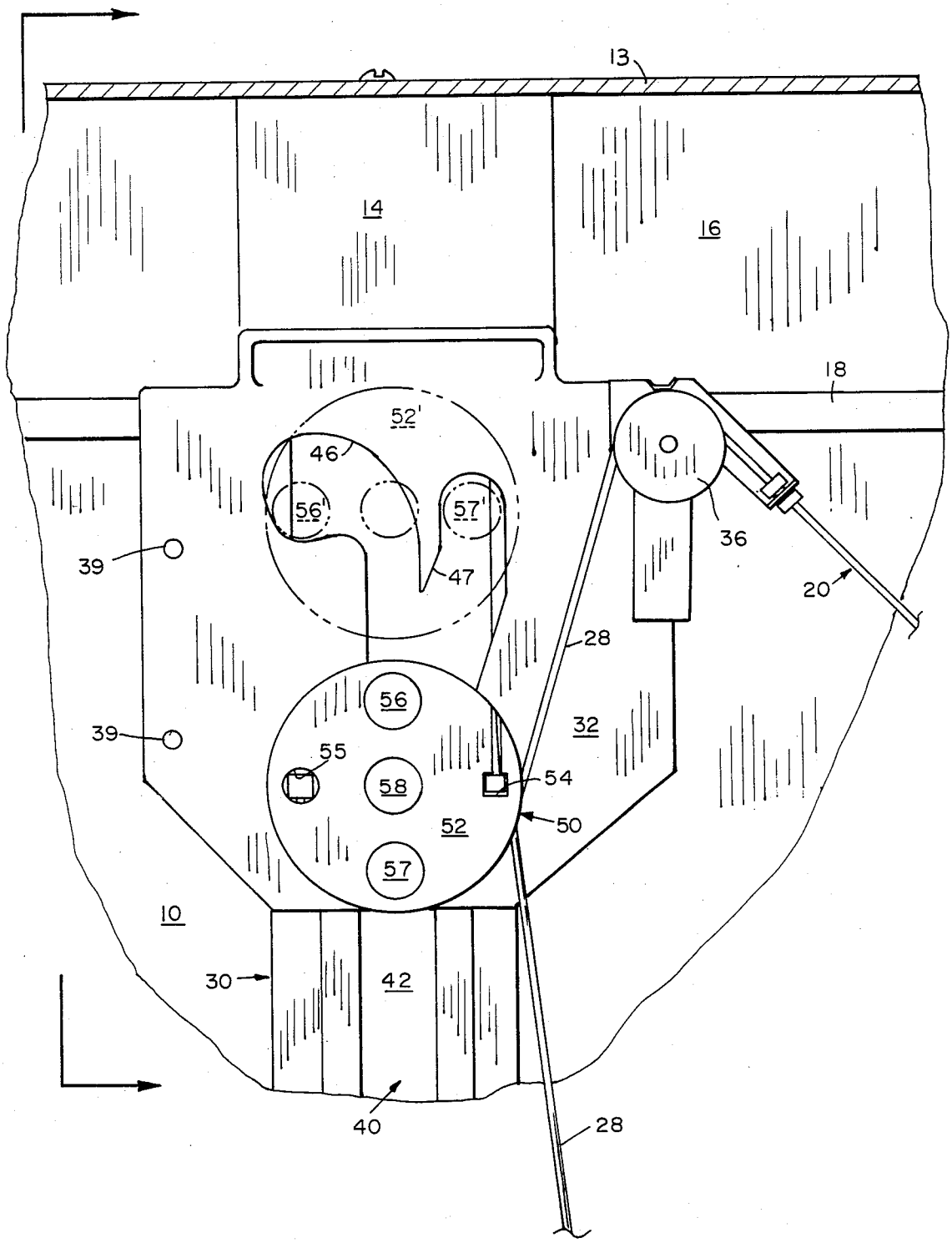
Fig II

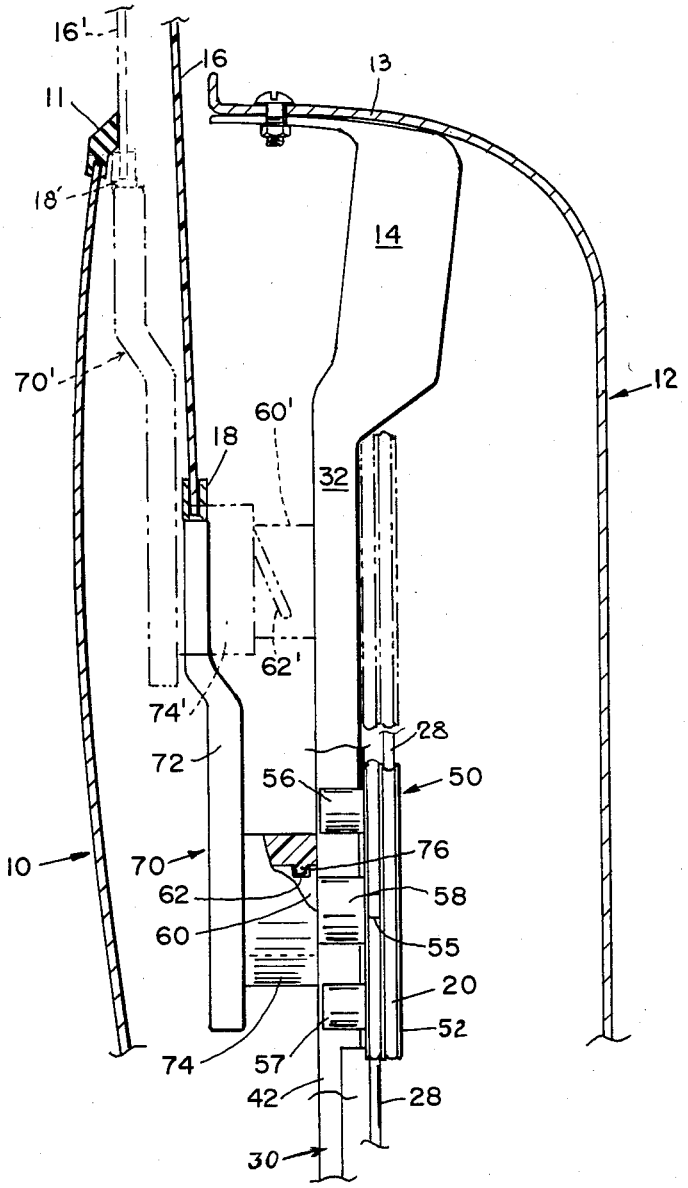
Fig III

FLUSH WINDOW REGULATOR

BACKGROUND OF THE INVENTION

The known prior art regulators which move windows both horizontally and vertically often require separate driving means for the two different directions of motion. If a single driving means were employed, a lever or a cam projected orthogonally of the plane and movement of the window is employed, which is usually an arcuate rather than orthogonal movement. All of these known prior art mechanisms for regulators required considerable space for their installation and their operating mechanism, and thus did not fit compactly in the modern thinner and curved-walled vehicle doors. Furthermore, the mechanisms employing levers often did not have positive movement in both directions in their horizontal planes, that is orthogonal to the surface of the door or window. Still further, these mechanisms were often quite complicated.

SUMMARY OF THE INVENTION

Generally speaking, the window regulator of this invention is adapted for doors for vehicles having a smooth curved outer surface in which the windows when closed are substantially flush with the outside surface. Since the windows and the doors in such vehicles are not flat but have curvature, when the windows are opened they often require more space between the inner and outer panels of the door and thus limit the amount of space remaining for their regulator mechanisms, which should be as compact as possible. Guides are usually required for the vertical edges of the window, including guides between the inner and outer panels of the lower door portion when the window is open or retracted therebetween. These guides also may be curved to conform with the curvature of the window panes and the adjacent outside surface of the vehicle body.

The regulator or operator of such windows includes a closed loop cable means which may be wire or tape, that pulls in either direction and wraps around a drum reversibly driven either manually or by a motor. This loop also has a guided vertical reach parallel to the general surface of the window and to its vertical motion in opening and closing.

According to the present invention, there is provided a substantially vertical slot or cam guide parallel to the vertical reach of cable means, and conforming with the curvature and/or angles of the up-and-down or closed-and-open motion of the window. The slot is bifurcated at its upper end to form a Y-shape, also in a plane parallel to that of the window. Attached to the vertical reach of cable is a pulley having diametrical axially parallel pins, rollers or cam followers that fit and move in the vertical cam slot to prevent the pulley from rotating until it reaches the Y-slots, at which time it is turned preferably between about 90° and 180° as the cables attached thereto continue to pull on the pulley, like when raising the window. This pulley also has axially attached thereto a helical groove in the outside of a cylinder, which cylinder is journalled in a socket having a pin fitting into the groove. This socket is rigidly attached to the carrier that is fastened to the lower edge of the window.

Thus, as the pulley attached to the vertical reach of cable is moved vertically up and down in its substantially vertical cam track slot or guide, the window correspondingly is moved from open to closed positions. However, when the window is in its vertical up, or closed position, continued pull on the cable rotates the pulley to screw outwardly the lower edge of the window so that it will be more flush with the outside surface of the door and vehicle. Correspondingly, reversal of the motion of the cable will positively retract the lower edge of the window inwardly so that it will be clear of the outer door panel and then continued downward pull on the vertical reach of cable will pull the two diametrical pins or cam followers on the pulley into the vertical cam guide slot and retract the window into the door between its inner and outer lower door panels.

OBJECTS AND ADVANTAGES

It is an object of this invention to produce a simple, efficient, effective, economic and compact flush window regulator mechanism.

Another object of this invention is to produce such a window regulator that moves a window vertically and then horizontally by means of a sole or the same driving force or means.

Still another object is to produce such a window regulator which s easy to operate, moves positively in all directions, and tightly seals the window when it is substantially flush with the outside body surface of the door or vehicle in which it is installed to give a smooth streamlined look to the vehicle.

BRIEF DESCRIPTION OF THE VIEWS

The above mentioned and other features, objects and advantages, and a manner of attaining them are described more specifically below by reference to an embodiment of this invention shown in the accompanying drawings wherein:

FIG. I is a side elevation of the flush window regulator according to a preferred embodiment of this invention with most of the door in which it is installed being broken away and only showing the lower part of the window that is attached to the regulator, which window is shown near its window-closed position;

FIG. II is an enlarged side elevational view of the upper Y-shaped cam slot and pulley shown in FIG. I showing the diametrical cam follower pins in full lines on the pulley just before entering the Y-slots, and showing the pulley in dotted lines in the Y-cam slots when the window is in its fully closed position and moved outwardly to be flush with the outside surface of the door and vehicle; and FIG. III is an edge view looking from the left in FIG. II showing similarly in full lines the pulley with parts broken away to show its diametrical cam follower pins in full lines near its upper window-closed, and showing the pulley in dotted lines when the window is in its fully closed position substantially flush with the outside panel of the door.

DETAILED DESCRIPTION OF PREFERRED EMBODIMENT

Figure 1:
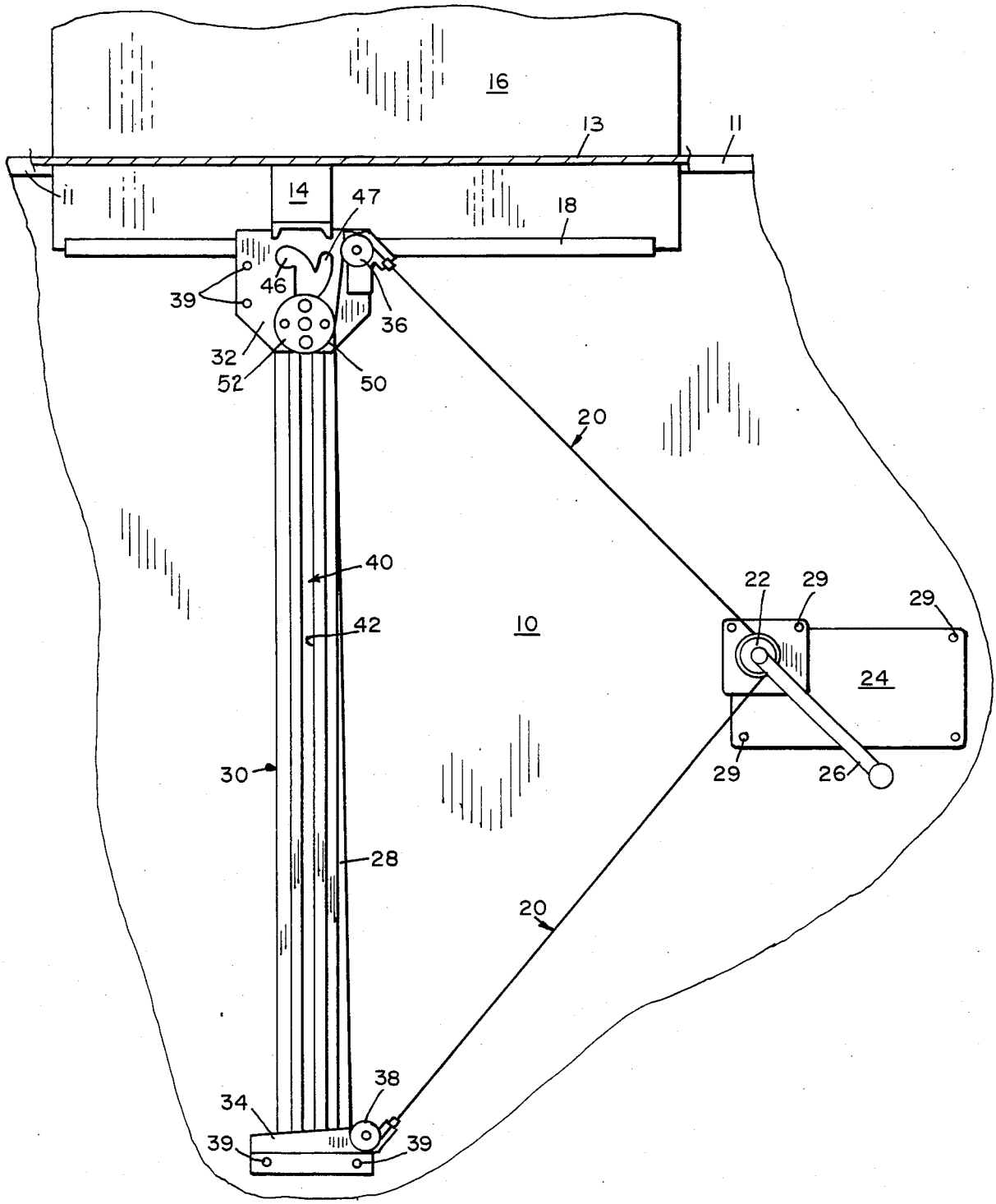

Since the invention is directed primarily to the mechanism for operating a window in a vehicle door, most of the parts of the vehicle door have been broken away. However, in the figures, sections of the outer door panel 10 and inner door panel 12 have been shown, with the inner door panel 12 being the base upon which the regulator mechanism parts are mounted, such as through a bracket 14 that may be bolted at its upper end to the window portion 13 of the inner door panel 12, which also forms the opening or slit through which the window moves. Opposite the sill 13 is the upper plastic or rubber seal 11 along the upper edge of the lower outer door panel 10 and the lower edge of the window opening. The lower portion of the window 16 is shown to have along its lower edge a U-shaped channel 18 which may comprise part of the carrier for the window which includes part of the regulator mechanism of this invention.

Referring now primarily to FIG. I there is shown the assembly of the whole regulator mechanism of this invention, which mechanism comprises basically a closed loop flexible cable means 20, a portion of which is wrapped around a driving drum 22. This drum 22 may be driven by an electric reversible motor 24 or by a hand crank 26. Thus, all movements of the window are caused by a pull in the cable in either one or the other direction. The closed loop 20 is also provided with a vertical reach 28 which is guided along a vertical bracket 30 parallel to said vertical reach 28. On the portions 32 and 34, at opposite ends of this bracket 30, are upper and lower guiding pulleys 36 and 38, respectively. There are provided means such as 29 and 39 on the driving means 24 and vertical bracket ends 32 and 34 for rigidly anchoring or fastening these parts to a frame or panel of the door between the inner and outer panels thereof. Also there may be provided sheaths such as tubing over the reaches of cable between the pulley 36 and drum 22, and pulley 38 and drum 22, if desired.

It should be understood that the vertical bracket or track 30, and even to a small degree its end portions 32, can be curved and/or angled from the true vertical to effectively parallel the travel of the curved window in a curved body-vehicle door.

The improvements of this invention comprise the cam slots 40, the rotary cam follower 50 and the socketed window carrier 70 (see FIG. III), which are described in more detail below:

The cam slots 40 comprise a vertical cam slot 42 extending along the full length of the vertical bracket 30 and into the lower part of the upper end portion 32, which end portion 32 has Y-shaped branched slots 46 and 47 (see FIG. II).

The pulley cam follower 50 comprises a double-grooved pulley 52 (see FIG. III) into one groove of which one end of the closed loop of cable means 20 is anchored, such as in notch 54 to wrap around the pulley 52 counterclockwise in FIG. II, and comprise part of the upper extension of the vertical reach 28. The other end of the cable means 20 and the shorter end of vertical reach 28 is attached to the other opposite side of the pulley 52 in notch 55 and is wrapped clockwise in FIG. II partly around the other parallel groove in the pulley 52.

Also diametric of the pulley 52, orthogonal to the diametric fastening means or notches 54 and 55, are a couple of cam followers, pins or rollers 56 and 57 (see FIGS. II and III) which move in the cam slots 40 to insure vertical motion of the window when in the vertical cam slot 42, and to provide horizontal motion of the lower edge of the window 16 when the cam followers 56 and 57 move into the branches of the Y-slot 46 and 47, respectively, as shown in dotted lines and primed numbers 52', 56' and 57' in FIG. II.

The pulley 52 has connected also to it a rigid cylindrical sleeve or shaft 58 axial of the pulley's axis and parallel to the axes of the cam followers 56 and 57, which shaft 58 is rigidly connected to a cylindrical screw-type member 60 (see FIG. III) which has a helical slot 62 therein.

Referring now to the carrier 70, most clearly shown in FIG. III, this carrier comprises a bracket 72 connected to the U-channel 18 on the bottom edge of the window 16 and also has rigidly anchored thereto a socket 74 which journals the cylindrical member 60 having the helical groove 62. This socket 74 has an internal pin which acts as a cam follower 76 in the helical slot 62. Thus the member 60 acts like a screw in the socket 74 which acts as a nut, so that oscillation of the pulley 52 and its member 60 screws the carrier 70 away and toward the pulley 52.

Thus, as the cam follower pulley 50 reaches the top of the vertical slot 42 continued pull on the upper reach of the cable means 20 will cause the cam follower pins or roller 56 or 57 to move in the branches 46 and 47, respectively, of the Y-slots, to rotate the pulley 52 about 90° and up to about 180°. This rotation thus causes the pin 76 in the carrier socket 74 to be moved, by the pitch helix slot 62, horizontally to unscrew the socket and move it horizontally into the dotted line position shown in FIG. III. Although this pitch is shown herein to be about 30°, it can be varied to accomplish desired results. This dotted line position, indicated by primed numbers 16', 18', 70'9, 74', 60' and 62', shows how the window 16 is moved to be substantially flush with the outer surface of the door panel 10 and to seal against the rubber or plastic strip 11 around the window opening in the door. Correspondingly, reversal of the direction of the cable means 20 will cause the rotatable pulley cam follower 50 to oscillate in the opposite direction and screw the carrier 70 back toward the vertical cam slot 42 and away from the window seal 11. Then continued pulling-down movement of the vertical reach 28 will open or retract the window 16 into the space between the inner and outer door panels.

Accordingly, the mechanism of this invention positively moves the window vertically, then horizontally, and then vice versa, to close and open the window of a vehicle in a door or other body, such as a vehicle, by means of a single reversible drive motor or manual crank in which movement in one direction closes and outwardly moves the lower edge of the window, and movement in the opposite direction inwardly moves the lower edge of the window and opens the window.

Elements of the regulator of this invention may be composed of metal or plastic, or both, and the cable means may be of wire, plastic cord, tape, or other material which has sufficient strength. There may be provided a mechanism for maintaining the cable means taut at all times, such as a spring inside the drum 22 or a spring-pressed pulley against a reach of the cable. although this mechanism has been primarily directed for use for windows in doors of vehicles, it also may be used in other bodies for moving other panels than windows where successive orthogonal motions are required that are positive in both directions.

While there is described above the principles of this invention in connection with specific apparatus, it is to be clearly understood that this description is made only by way of example and not as a limitation to the scope of this invention.

We claim:

1. A reciprocating driving mechanism for vertically and horizontally moving the lower edge of a window in a housing, comprising:

(1) a substantially vertical tract in said housing having a vertical guiding slot ending at its upper end into bifurcated cam slots, (2) a carrier for the lower edge of said window comprising a horizontal movable portion attached to said edge of said window and a rotary portion connected by a helical cam means to said horizontal portion, whereby oscillation of said rotary portion reciprocates horizontally said horizontal portion, said rotary portion having a pulley means and a pair of diametrically spaced pins guided in said vertical guiding slot and in and out of said bifurcated cam slots for oscillating said rotary portion, (3) cable means attached to said pulley means of said rotary portion for vertically reciprocating said carrier along said tract in said vertical cam guiding slot and oscillating said rotary portion guided by said pins in said bifurcated slots, (4) drum means for winding and unwinding said cable means, and (5) means for reversibly rotating said drum means; whereby when said window is closed, its lower edge moves outwardly to be more flush with the outside surface of said housing.

2. A reciprocating driving mechanism according to claim 1 wherein said horizontal movable portion of said carrier comprises a pin movable in said helical cam means.

3. A reciprocating driving mechanism according to claim 1 wherein opposite ends of said cable means are anchored in said pulley means.

4. A reciprocating driving mechanism according to claim 1 wherein said means for reversibly rotating said drum means comprises a reversible electric motor and gear mechanism.

5. A flush vehicle window regulator comprising:

(1) a substantially vertical track having a vertical slot bifurcated at its upper end, (2) a carrier for the lower edge of said window, (3) a pulley means oscillatable about a horizontal axis journalled in said carrier and connected thereto by a helical cam means for horizontally reciprocating said carrier when said pulley means is oscillated, said pulley means having a pair of diametrically spaced pins guided in said slot and for rotating said pulley when said pins are in said bifurcated portion of said slot, (4) linear flexible means attached to said pulley for reciprocating said carrier along said vertical track and oscillating said pulley means, (5) drum means for winding and unwinding said linear flexible means, and (6) means for reversibly rotating said drum means whereby said window is opened and closed and when in its closed position its lower edge is moved outwardly to be more flush with the outside surface of said vehicle.

6. A window regulator according to claim 5 wherein said helical cam means includes a cam follower on said carrier.

7. A window regulator according to claim 5 wherein said spaced pins include rollers.

8. A flush window regulator comprising a body having spaced inner and outer walls and an opening for a window, means between said walls for raising and lowering said window to close and open said opening, said regulator comprising:

(1) a closed loop of flexible cable means, (2) a drum for wrapping and unwrapping a section of said cable means, (3) means for reversibly driving said drum, (4) means for guiding a section of said cable means along a substantially vertical reach, (5) a pulley connected to said vertical reach of said cable means, said pulley having a pair of diametrically spaced cam followers and having an axial cylindrical portion with a helical groove therein, (6) a vertical cam slot for said cam followers parallel to said vertical reach and having a Y-branched slot at its upper end for rotating said pulley, and (7) a carrier for the lower edge of said window having a socket with a pin meshed in said helical groove of said sleeve on said pulley, whereby pull on said cable means in one direction first raises said window while said pulley's diametric cam followers are in said vertical cam slot, and whereby further pull on said cable means in the same direction when the window carrier is at the top of said vertical cam slot, rotates said pulley to horizontally move said carrier by screwing said socket outwardly to cause said window to be more flush with the outside surface of said body, and reversing the direction of said cable means correspondingly reverses said motion of said window to move it inwardly away from said outer surface of said body and then downwardly into the space between the walls of said body.

9. A window regulator according to claim 8 wherein said helical groove has about a 30° pitch.

10. A window regulator according to claim 8 wherein said Y-branched slots rotate said pulley about 90°.

* * * * *